US012110145B2

(12) United States Patent
Kim et al.

(10) Patent No.: US 12,110,145 B2
(45) Date of Patent: Oct. 8, 2024

(54) OPENING SYSTEM OF PACKAGING BOX

(71) Applicant: CJ CHEILJEDANG CORPORATION, Seoul (KR)

(72) Inventors: Myung Ho Kim, Jincheon-eup (KR); Sung Woo Park, Jincheon-eup (KR); Bong Yong Sung, Gimhae-si (KR); Hee Dong Son, Changwon-si (KR); Dae Hwa Kim, Osan-si (KR); Sun Kyu Kim, Hwaseong-si (KR); Soo Hyun Kim, Gimpo-si (KR); Hak Dong Kim, Suwon-si (KR); In Soo Jung, Suwon-si (KR)

(73) Assignee: CJ CHEILJEDANG CORPORATION, Seoul (KR)

( * ) Notice: Subject to any disclaimer, the term of this patent is extended or adjusted under 35 U.S.C. 154(b) by 125 days.

(21) Appl. No.: 17/801,158

(22) PCT Filed: Feb. 19, 2021

(86) PCT No.: PCT/KR2021/002128
§ 371 (c)(1),
(2) Date: Aug. 19, 2022

(87) PCT Pub. No.: WO2021/167402
PCT Pub. Date: Aug. 26, 2021

(65) Prior Publication Data

US 2023/0071621 A1 Mar. 9, 2023

(30) Foreign Application Priority Data

Feb. 19, 2020 (KR) ..... 10-2020-0020680

(51) Int. Cl.
*B65B 43/26* (2006.01)
*B65B 43/30* (2006.01)
*B65B 69/00* (2006.01)

(52) U.S. Cl.
CPC ..... *B65B 43/265* (2013.01); *B65B 43/305* (2013.01); *B65B 69/0033* (2013.01)

(58) Field of Classification Search
CPC . B65B 43/265; B65B 43/305; B65B 69/0033; B65B 43/39; B65B 69/00
See application file for complete search history.

(56) References Cited

U.S. PATENT DOCUMENTS 3,224,166 A * 12/1965 Johns ..... B65B 43/39 53/382.1
3,662,516 A * 5/1972 Wiseman ..... B65B 43/39 53/76

(Continued)

FOREIGN PATENT DOCUMENTS

DE 102011108798 A1 1/2013
DE 102015115309 A1 * 3/2017 ..... B65B 69/0033

(Continued)

OTHER PUBLICATIONS

Machine translation of Mayer to DE-102015115309-A1 (Year: 2017).*

(Continued)

*Primary Examiner* — Thomas M Wittenschlaeger
*Assistant Examiner* — Himchan Song
(74) *Attorney, Agent, or Firm* — DILWORTH IP, LLC

(57) ABSTRACT

An opening system including a cutting device for cutting an adhesive tape; a suctioning and lifting device for suctioning a upper panels, which are separated from each other because the adhesive tape is cut by the cutting device; rod members which are elongated to be inserted into gaps, when the gaps are formed between the upper panels and upper edges of side surfaces in the packaging box because the upper panels are spaced apart from the side panels by the suctioning and lifting device; and an opening device which moves the respective rod members while being in contact with lower (Continued)

surfaces of the upper panels such that the upper panels are rotated outward with respect to boundaries between the upper panels and the side panels.

7 Claims, 6 Drawing Sheets

(56) References Cited

U.S. PATENT DOCUMENTS

| | | | | | |
|---|---|---|---|---|---|
| 4,478,023 | A | * | 10/1984 | Becker | B65B 43/39 53/382.3 |
| 4,543,767 | A | * | 10/1985 | Wiseman | B65B 43/39 53/76 |
| 2018/0362200 | A1 | * | 12/2018 | Scaglione | B65B 43/265 |
| 2023/0071621 | A1 | * | 3/2023 | Kim | B65B 43/39 |

FOREIGN PATENT DOCUMENTS

| | | | |
|---|---|---|---|
| JP | 09-124017 | A | 5/1977 |
| JP | 2005-047555 | A | 2/2005 |
| KR | 10-0637338 | B1 | 10/2006 |
| KR | 10-2136514 | B1 | 7/2020 |
| WO | 2007105970 | A1 | 9/2007 |
| WO | 2018-230718 | A1 | 12/2018 |

OTHER PUBLICATIONS

International Search Report from WIPO in related Application No. PCT/KR2021/002128 dated Jun. 16, 2021, 8 pages.

Extended European Search Report issued in EP Application No. 21757592.7, mailed on Aug. 1, 2023.

* cited by examiner

OPENING SYSTEM OF PACKAGING BOX

FIELD OF THE INVENTION

The present invention relates to an opening system of a packaging box, and more particularly, to a system for automatically opening a packaging box having a rectangular parallelepiped shape and opened by unfolding panels which serve as the upper surface or lower surface of the packaging box.

BACKGROUND OF THE INVENTION

A box having a rectangular parallelepiped shape has been generally used as a packaging container for transporting and storing a product.

FIG. 1 shows a generally-used type of packaging box.

A packaging box 1 may be mainly made of a paper panel coated with a synthetic resin film, and may have upper and lower surfaces each covered and closed with four panels extended from side panels of the packaging box.

The upper surface and lower surface of the packaging box have the same structure as each other, and the upper surface is thus described with reference to FIG. 1. Here, four panels 2, 3, 4 and 5 may be two pairs of panels, and may be folded from an edge of the side panel, and end portions of the panels may thus be in contact with or adjacent to each other, thereby closing the upper surface of the packaging box. A pair of panels 4 and 5 may be folded to be opposite to each other, and the other pair of panels 2 and 3 may then be folded to be opposite to each other and then placed perpendicular to the previously folded pair of panels 4 and 5.

In this way, the upper surface of the packaging box may be closed, and the first pair of panels 2 and 3 may be folded to be placed on the other pair of the panels while having the end portions coming into contact with each other, and bonded to each other by using an adhesive tape to be closed, such that the packaging box is not opened by an external force.

First, the packaging box may be closed by having its lower surface configured in the same manner as the upper surface, and the product may be put from the upper surface of the packaging box and accommodated therein. As described above, the packaging box may then be closed by folding the panels 2, 3, 4 and 5 serving as the upper surface of packaging box and then by bonding the end portions of the pair of panels 2 and 3 by using the adhesive tape, and the closed packaging box may then be transported.

Meanwhile, when the packaging box configured as described above and accommodating the product is opened to take out the product therefrom, the adhesive tape bonding the panels 2 and 3 to each other may be cut with a knife or the like, the panels 2, 3, 4 and 5 may then be all unfolded outward to open the upper surface of the packaging box, and the product accommodated in the packaging box may then be taken out.

This operation may be performed directly by a person. However, in a manufacturing process of producing a large amount of product, it may be a very monotonous operation, may require a lot of labor and may be a factor increasing a manufacturing cost, to open the packaging box which accommodates a component, a material, a container or the like of the product, and to take out the product in the packaging box and put the product into the manufacturing process.

Korean Patent Laid-Open Publication No. 10-1988-0010986 (Document 1) discloses an invention entitled "PACKAGING BOX EASILY OPENED AND PACKAGING METHOD THEREOF." The packaging box according to the invention disclosed in Document 1 may be easily opened. However, such a packaging box has no choice but to be opened manually by a person. Accordingly, this invention has no essential difference in requiring human labor to open the packaging box.

As such, in the prior art, there is no disclosure or consideration for technology for automatically opening the packaging box.

SUMMARY OF THE INVENTION

Technical Problem

An embodiment of the present invention provides an opening system of a packaging box.

In detail, an embodiment of the present invention provides an opening system for automatically opening a packaging box by allowing panels which are corresponding surfaces of the packaging box to be separated from each other to be unfolded outward, in which the packaging box has a rectangular parallelepiped shape and is closed in such a manner that the panels each extended from the opposite side surfaces of the packaging box to be surfaces of the packaging box, are folded to be in contact with each other and then bonded to each other by using an adhesive tape or the like.

Technical Solution

According to an embodiment of the present invention, an opening system may open the packaging box including upper panels respectively extended from side panels opposite to each other to serve as an upper surface, and bonded to each other by using an adhesive tape as their end portions are in contact with each other, thereby closing the upper surface.

The opening system of a packaging box includes:

a cutting device for cutting the adhesive tape while being moved along the end portions of the upper panels, opposite to each other; a suctioning and lifting device for suctioning the upper panels separated from each other because the adhesive tape thereon is cut by the cutting device, and pulling the upper panels upward from the packaging box for the upper panels to be spaced apart from the side panels; rod members elongated to be inserted into gaps when the gaps are formed between the upper panels and upper edges of side surfaces of the packaging box because the upper panels are spaced apart from the side panels by the suctioning and lifting device; and an opening device for moving the respective rod members maintained in contact with lower surfaces of the upper panels for the upper panels to be pivoted outward their boundaries with the side panels.

According to the opening system of this configuration, a product may first be accommodated in the packaging box from the outside, and the packaging box in which upper panels serving as the upper surface may be sealed by the adhesive tape may be introduced into the cutting device.

First, the adhesive tape bonding the upper panels to each other may be cut by the cutting device, and the suctioning and lifting device may suction and lift the upper panel. In this case, gaps may be formed between the upper panels and upper edges of side surfaces of the packaging box, and the rod members may be inserted into the gaps.

The rod member may be moved by the opening device to pivoted the upper panel. Here, the rod member introduced into the gap may be in contact with the lower surface of the upper panel. When the rod member is moved outward the packaging box, the upper panel may receive an outward pressuring force by the rod member, and opened by being pivoted outward the packaging box while being rotated about its boundary with the side panel of the packaging box, which is a rotation axis.

Meanwhile, the packaging box may include four side panels and four upper panels each extended from the four side panels, the upper panels may include a first pair of two upper panels opposite to each other and a second pair of two upper panels opposite to each other and placed perpendicular to the first pair of upper panels, the first pair of upper panels may be placed on the second pair of upper panels and bonded to each other by the adhesive tape as their end portions are in contact with each other, and the second pair of upper panels may include end portions opposite to each other.

Here, in the opening system of the present invention,

The rod members may be provided for the respective upper panels, the cutting device may be provided to cut the adhesive tape bonding the first pair of upper panels to each other, and the suctioning and lifting device may be provided to suction each of the first pair of upper panels and the second pair of upper panels.

As an additional feature of the present invention, the opening device may perform a first movement for linearly moving the respective rod members outward the packaging box and a second movement for linearly moving the respective rod members downward the packaging box, and the upper panel may be opened by being pivoted from the upper surface of the packaging box in the first movement, and the upper panel may be placed to be in contact with an outer surface of the side panel in the second movement.

As specific components of the opening device for performing this operation, the opening device may include a first driving unit driven to be adjacent to or spaced apart from the packaging box, a second driving unit coupled to and driven vertically with respect to the first driving unit, a fixed block coupled to and moved with respect to the second driving unit in a horizontal direction or at a predetermined inclination angle in the horizontal direction, and a rod member fixed to the fixed block and extended parallel to a direction in which the first driving unit is driven.

Advantageous Effects

In the opening system according to the present invention, the upper panels which serve as the upper surface of the packaging box by being bonded to each other by the adhesive tape may be separated from each other and then pivoted outward to be opened, and the product accommodated in the packaging box may thus be taken out from the opened upper surface.

Even the packaging box having two pairs of upper panels may be opened automatically by the opening system according to the present invention.

The rod member may perform the two linear movements to pivot the upper panel of the packaging box from its position of closing the upper surface of the packaging box to its position of being opened to be in the close contact with the outside of the side surface of the packaging box. Therefore, the opening device for moving the rod member may only perform the simple two-direction linear movements rather than a complicated operation. As a result, the opening device may have the simple configuration and thus be easily controlled. In particular, the movement of the rod member and the operation of opening the upper panels may be performed without an error.

BRIEF DESCRIPTION OF THE DRAWINGS

FIG. 9 is a longitudinal cross-sectional view of the same in a transport direction; FIGS. 10 and 11 are traverse cross-sectional views of the same; and FIG. 12 is a perspective view of the same.

DETAILED DESCRIPTION OF THE INVENTION

Hereinafter, the description describes the configuration and operation of an opening system of a packaging box according to an embodiment of the present invention as detailed contents for carrying out the present invention with reference to the drawings.

Figure 2:
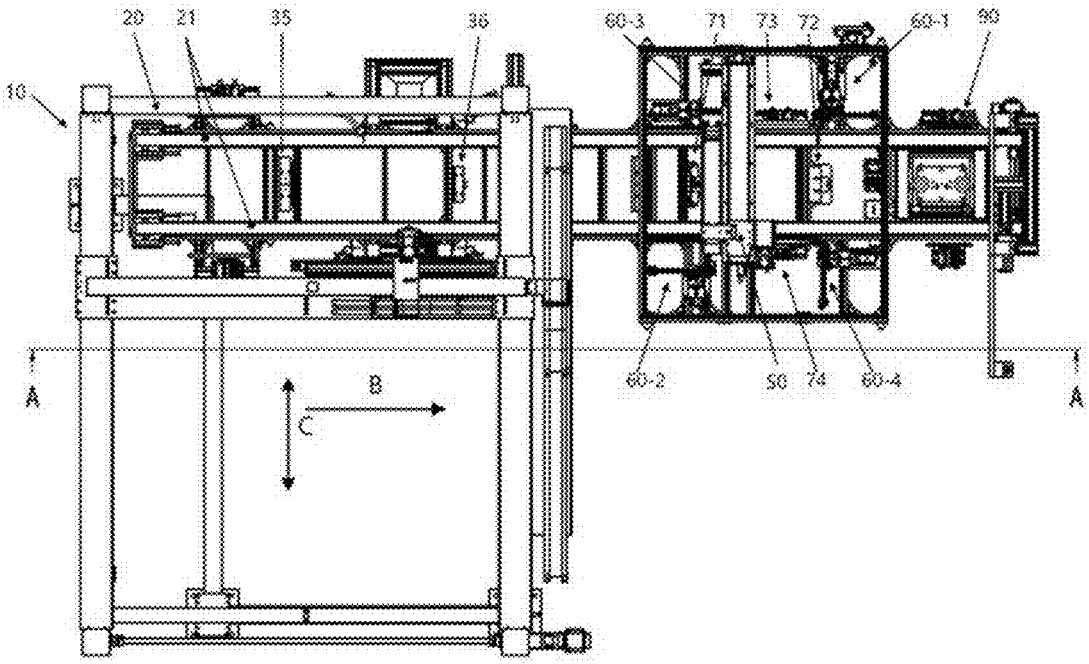
FIG. 2 is a plan view showing the opening system of an embodiment of the present invention.
Figure 3:
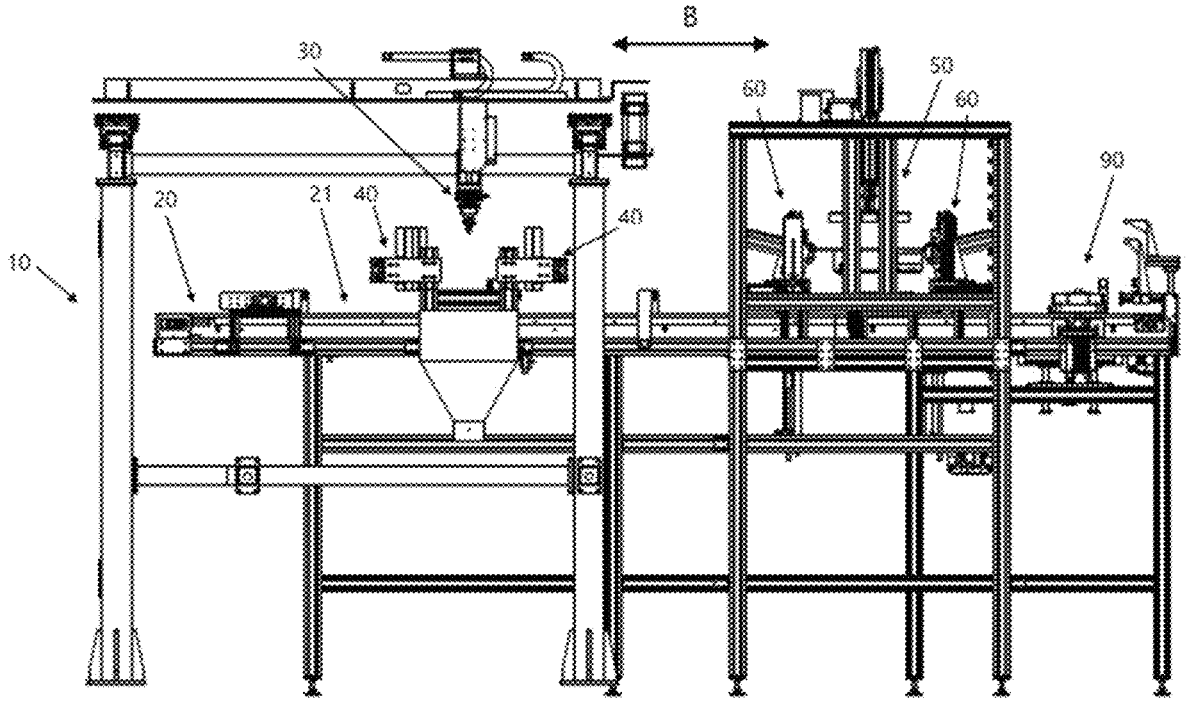
FIG. 3 is a longitudinal cross-sectional view taken along line A-A of FIG. 2.

First, the description describes the overall configuration and arrangement of the opening system of a packaging box according to an embodiment of the present invention with reference to FIGS. 2 and 3.

Figure 1:
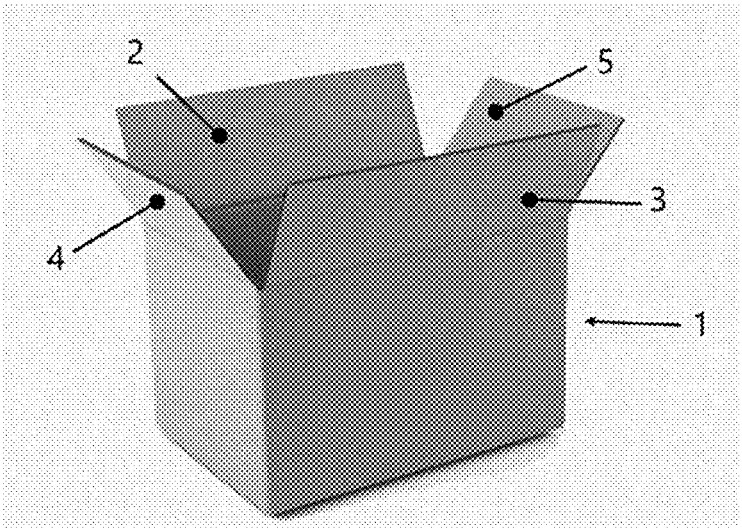
FIG. 1 is a perspective view showing that opened is a packaging box of a type to be opened by an opening system according to an embodiment of the present invention.

A packaging box 1 of this embodiment may be a packaging box to be opened as shown in FIG. 1.

The packaging box 1 may be transported from a warehouse or transport vehicle by an unmanned transport vehicle or a person, positioned on a conveyor (not shown) introduced into adhesive tape-cutting devices 30 and 40 which are parts of the opening system of this embodiment, and then introduced into the cutting devices 30 and 40.

The packaging box 1 may be introduced into the cutting devices 30 and 40, and the adhesive tape on its upper surface may be cut by the cutting devices 30 and 40. The packaging box 1 may then be introduced into opening devices 50 and 60 positioned adjacent to the cutting devices.

The cutting devices 30 and 40 and the opening devices 50 and 60 may be arranged in a frame device 10 provided by combining several channels with each other. The frame device 10 may be provided with a transport device 20 extended from the cutting devices 30 and 40 through the opening devices 50 and 60, and the packaging box 1 introduced from the outside may be transported by conveyor belts 21 of the transport device 20, which are circulated and spaced apart from each other, and sequentially transported through the cutting devices 30 and 40 and the opening devices 50 and 60 to have the upper surface opened.

In the following description and throughout this specification, a "transport direction" may refer to a direction (indicated by arrow "B") in which the conveyor belt 21 transports the packaging box 1, and a "width direction" may refer to a direction (indicated by arrow "C") perpendicular to the transport direction.

The packaging box 1 whose upper surface is opened by the opening devices 50 and 60 may be transported downstream of the conveyor belt 21, and a take-out device 90 for taking out a product from the packaging box 1 whose upper surface is opened may be positioned downstream of the conveyor belt 21. The take-out device 90 is not included in the present invention, and a description thereof is thus omitted herein.

Figure 4:
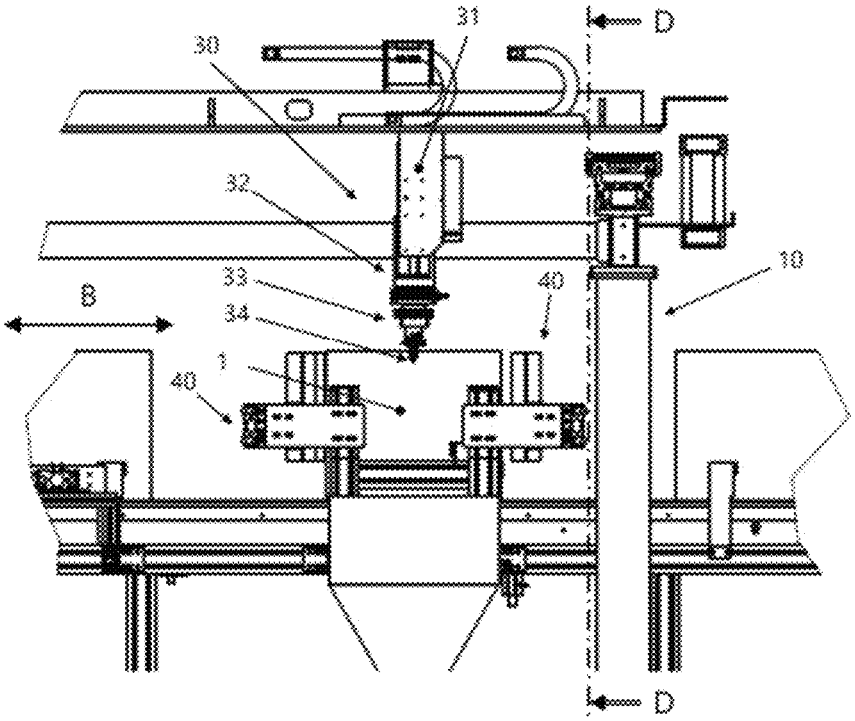
FIG. 4 is a plan view showing a cutting device included in the opening system of an embodiment of the present invention.
Figure 5:
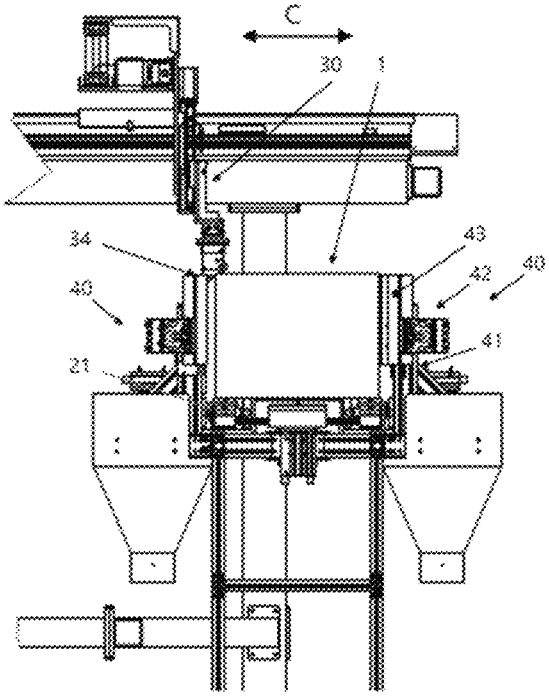
FIG. 5 is a longitudinal cross-sectional view taken along line D-D of FIG. 4.

Next, the description describes the configuration and operation of the cutting devices 30 and 40 in detail with reference to FIGS. 4 and 5.

The cutting devices 30 and 40 may include: a movement unit 31 moved from an upper portion of the frame device 10 in the transport direction and the width direction; a rotation unit 32 coupled to a lower portion of a carrier and driven up and down; a fixed unit 33 to which a cutting blade rotated by the rotation unit 32 is attached; and a cutting module 30 including a cutting blade 34 attached to a lower end of the fixed unit 33.

According to this configuration, the cutting blade 34 may be moved on the packaging box 1 transported by the conveyor belt 21, and cut the adhesive tape on the upper surface of the packaging box 1.

The packaging box 1 is the same as that shown in FIG. 1. When described with reference to FIG. 1, a first pair of upper panels 2 and 3 on the upper surface of the packaging box 1 may be bonded to each other by the adhesive tape, and the adhesive tape may be extended not only to end portions of the upper panels 2 and 3, opposite to each other, but also be extended to side panels, and then attached thereto.

The packaging box 1 may be placed on the conveyor belt 21 by taking, as the width direction "C," a direction in which the adhesive tape is elongated and attached to the packaging box, and the cutting blade 34 may cut the adhesive tape while being moved from one end portion of each of the upper panels 2 and 3 to the other end portion by the movement unit 31.

The cutting blade 34 may then cut gaps between the upper panels 2 and 3 and the side surfaces while being moved in the transport direction after the rotation unit 32 is rotated by 90 degrees. After cutting the adhesive tape on one side in the width direction, the cutting blade 34 may be moved to the opposite side by the movement unit 31 to cut the adhesive tape on the opposite side.

In this way, the upper panels 2 and 3 of the packaging box 1 may be separated from each other and also separated from the side surfaces of the packaging box 1, such that the packaging box is able to be opened.

In this embodiment, the cutting blade 34 for cutting the adhesive tape on the packaging box 1 may be moved and cut the adhesive tape while pressing the adhesive tape because the rotation unit 32 is pressed downward with respect to the movement unit 31. However, it is also possible to dispose a rotating saw on the fixed unit 33.

Meanwhile, while the packaging box 1 placed on the conveyor belt 21 is cut by the cutting blade 34, the packaging box 1 may be required to be positioned on a predetermined position, i.e., a path on which the cutting blade is moved to cut the adhesive tape on the packaging box 1, and not to be shaken or moved by a cutting pressure during the cutting.

Elements for positioning the packaging box 1 in place on the frame device 10 and fixing the packaging box 1 during the cutting may be arranged under the cutting blade 34 and units moving the cutting blade.

First, referring to FIG. 2, the packaging box 1 introduced from the outside may be transported by the conveyor belt 21 and wait upstream of the conveyor belt on which the cutting blade 34 is moved, while the packaging box previously introduced is cut, or while the packaging box which is previously introduced and from which the adhesive tape is cut stays without being transported downstream of the conveyor belt.

Referring back to FIG. 2, a first stop plate 35 driven in a vertical direction may be positioned below and between the conveyor belts 21, and when another packaging box waits downstream of the conveyor belt, the packaging box 1 newly introduced may wait by being brought into contact with the first stop plate 35 raised above the conveyor belt 21.

A second stop plate 36 may be positioned downstream of the first stop plate 35. The second stop plate 36 may also be driven in the vertical direction between the conveyor belts 21 like the first stop plate 35, and when the packaging box 1 from which the adhesive tape is to be cut by using the cutting blade 34 is introduced thereto, the second stop plate 36 may be raised above the conveyor belt 21 to stop the movement of the packaging box 1.

When the packaging box 1 is positioned in place, the conveyor belt 21 may stop the circulation. However, the packaging box 1 may not be exactly stopped in place by the conveyor belt 21, and the packaging box 1 may be stopped in place by the second stop plate 36.

In addition, a third stop plate (not shown) may be positioned upstream of the second stop plate 36. The third stop plate may also be driven in the vertical direction between the conveyor belts 21, and when the packaging box 1 is transported and stopped in contact with the second stop plate 36, the third stop plate may be raised above the conveyor belt 21. The third stop plate may be positioned opposite to the second stop plate 36 to fix the packaging box 1 from both sides of the packaging box in the transport direction.

The third stop plate may be attached to a pneumatic actuator (not shown), and the pneumatic actuator may press the third stop plate toward the downstream of the conveyor belt in the transport direction after the packaging box 1 is stopped to press the packaging box 1 in the transport direction.

Accordingly, the packaging box 1 may be placed at a predetermined position as a cutting position in the transport direction.

Arranged are four fixing modules 40 for fixing the packaging box 1 during the cutting.

Each fixing module 40 may include a fixing bracket 41 fixed to the frame device 10 outward the conveyor belt 21 in the width direction and vertically extended, an actuator 42 fixed on the fixing bracket 41 and actuated linearly by pneumatic pressure, and a contact panel 43 fixed to a tip of the actuator 42.

The fixing module 40 may be positioned to face an edge of the side surface of the packaging box 1 from the cutting position of the packaging box 1, and the actuator 42 may be inclined in the width direction and the transport direction and positioned to be actuated linearly toward the edge.

The contact panel 43 fixed to the tip of the actuator may have an "L" shape to match a shape of the edge of the packaging box 1, and may be moved linearly by the actuator 42 to be in contact with the edge of the packaging box 1.

According to this configuration, the packaging box 1 may be transported to be positioned in place by the second and third stop plates, and the actuator 42 of each fixing module 40 may then be actuated to linearly move the contact panel 43 toward each edge of the packaging box 1, and the packaging box may be in contact with the contact panel 43 to be stopped.

Accordingly, the packaging box 1 may be precisely positioned in place in the width direction and the transport direction, and the cutting blade 34 may then cut the adhesive tape on the packaging box by movement of the movement unit 31 in the transport direction and the width direction, movement of the rotation unit 32 in the vertical direction, and rotational movement of the fixed unit 33.

When all the adhesive tapes on the packaging box are cut in this way, the second stop plate 36, the third stop plate (not shown) and the contact panel 43 may be all retreated from the packaging box 1 to release the contact with the packaging box, and the conveyor belt 21 may be moved to transport the packaging box to the position of the opening devices 50 and 60.

Figure 6:
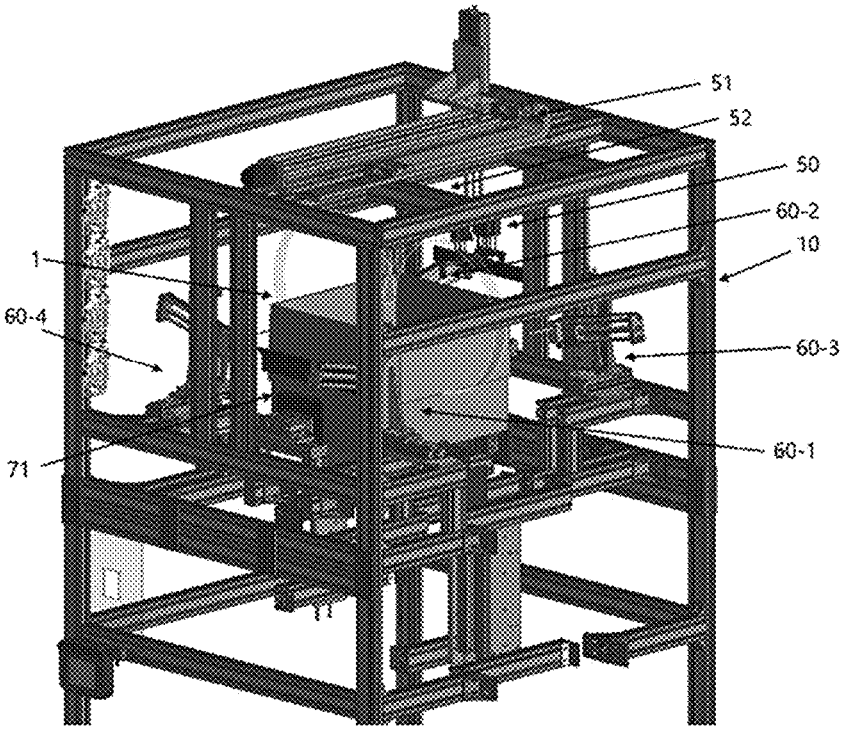
FIG. 6 is a perspective view showing an opening device included in the opening system of an embodiment of the present invention.

First, the description describes the overall configuration of the opening device with reference to FIG. 6.

The opening devices may include: a suctioning and lifting device 50 for suctioning and lifting the first pair of upper panels 2 and 3 and a second pair of upper panels 4 and 5, from which the adhesive tape is cut; the opening device 60 including a rod member 68 for opening each upper panel 2, 3, 4 or 5 by rotating the panel with respect to the packaging box 1 and driving units for driving the rod member 68; and means for positioning and fixing the packaging box 1 in place while the upper panels are opened by the opening device 60.

Fourth to seventh stop plates may be provided as the means for positioning and fixing the packaging box 1 in place.

A fourth stop plate 71 and a fifth stop plate 72 (in FIG. 2) may be positioned opposite to each other in the transport direction. The fourth stop plate 71 may be positioned upstream of the conveyor belt in the transport direction, driven in the vertical direction between the conveyor belts 21 like the second stop plate 36, and raised above the conveyor belt 21 to stop the movement of the packaging box 1 when the packaging box 1 is transported.

The fifth stop plate 72 may be driven in the vertical direction between the conveyor belts 21 like the third stop plate (not shown), raised above the conveyor belt 21. When the packaging box 1 is transported and stopped while being brought into contact with the fourth stop plate 71, and may press the packaging box toward the downstream of the conveyor belt in the transport direction by using the driving unit (not shown) actuated linearly by the pneumatic pressure.

The fifth stop plate 72 may be positioned opposite to the fourth stop plate 71 to fix the packaging box 1 from both sides of the packaging box in the transport direction.

In addition, a sixth stop plate 73 (in FIG. 12) and a seventh stop plate 74 (in FIG. 2) may be positioned outward the conveyor belt 21 in the width direction while being opposite to each other, and fix the packaging box 1 from both the sides of the packaging box in the width direction. These stop plates may be positioned at a height of the packaging box 1 without being lifted up and down, and when the packaging box 1 is positioned in place, the stop plates may press the packaging box 1 from both the sides of the packaging box in the width direction by using the driving unit (not shown) actuated linearly by the pneumatic pressure to fix the packaging box.

The suctioning and lifting device 50 may be operated when the packaging box 1 transported by the conveyor belt 21 may be positioned in place and fixed by the fourth to seventh stop plates 71 to 74 in this way.

Figure 7:
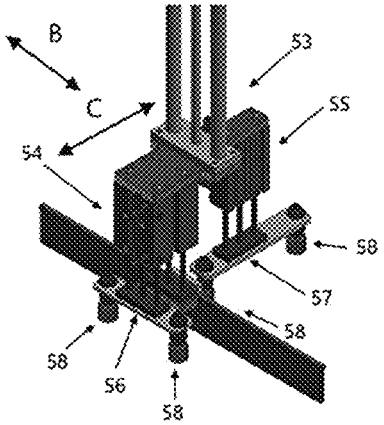
FIGS. 7 and 8 are perspective views each showing a suctioning and lifting device and the opening device included in the opening system shown in FIG. 6.

The description describes the suctioning and lifting device 50 with reference to FIG. 7 together with FIG. 6.

The suctioning and lifting device 50 may be positioned above the packaging box 1. On the frame device 10, provided are a first movement unit 51 extended in the transport direction and positioned, and a second movement unit 52 extended in the transport direction and coupled to the first movement unit 51 to be moved in the width direction, and a mounting block 53 lifted up and down by the second movement unit 52 and positioned at a lower portion of the second movement unit 52.

The mounting block 53 may be mounted with two actuators 54 and 55 pneumatically lifted, first and second mounting panels 56 and 57 may each be attached to a tip moved up and down at the actuator, and two vacuum aspirators 58 connected to a vacuum source may be mounted on each of the mounting panels 56 and 57 while being spaced apart from each other.

The first mounting panel 56 may be extended in the width direction "C" and the second mounting panel 57 may be extended in the transport direction "B," such that the vacuum aspirators 58 mounted thereon may be positioned perpendicular to each other.

The two vacuum aspirators 58 mounted on the first mounting panel 56 may respectively be positioned to correspond to the first pair of upper panels 2 and 3 among the upper panels of the packaging box 1 to lift the respective upper panels 2 and 3 by vacuum suction, and the two vacuum aspirators 58 mounted on the second mounting panel 57 may respectively be positioned to correspond to the second pair of upper panels 4 and 5 among the upper panels of the packaging box 1 to lift the respective upper panels 4 and 5 by the vacuum suction.

Figure 8:
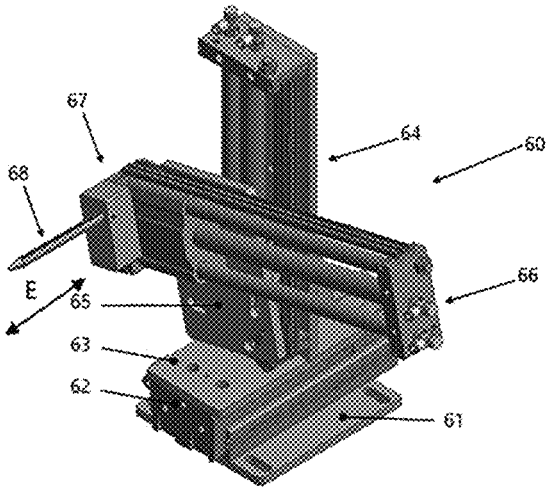

Next, the description describes the configuration and operation of the opening device 60 with reference to FIG. 8 showing one opening device 60 together with FIG. 6.

First, the description describes the configuration of the opening device 60 with reference to FIG. 8.

The opening device 60 may include: a fixed plate 61 fixed to the frame device 10; a first driving unit 62 mounted with a first plate 63 linearly moved on a plane of the fixed plate 61, while being parallel to the ground, by the pneumatic pressure in one direction; a second driving unit 64 mounted with a second plate 65 vertically extended from an upper surface of the first plate 63 of the first driving unit 62 to be driven vertically and linearly by the pneumatic pressure; a third driving unit 66 mounted with a fixed block 67 fixed to the second plate 65 of the second driving unit 64, having an inclination angle from a plane horizontal to the ground, and driven linearly by the pneumatic pressure; and a rod member 68 fixed to the fixed block of the third driving unit 66 and extended in a direction (indicated by arrow "E") in which the first plate 63 is linearly moved.

The rod member 68 of the opening device 60 may approach the packaging box 1 or be retreated from the packaging box 1 by the linear movement of the first plate 63 in one direction "E" by the first driving unit 62, and the rod member 68 may pivot the upper panels 2, 3, 4 and 5 of the packaging box 1 by the vertical movement of the second plate 65 by the second driving unit 64 and the linear movement of the fixed block 67 by the third driving unit 66 in the direction inclined to the ground.

As shown in FIG. 6, as the opening device 60 having this configuration and operation, provided are four opening devices 60-1, 60-2, 60-3 and 60-4 corresponding to the respective upper panels 2, 3, 4 and 5 of the packaging box 1, and arranged one by one in the upstream and downstream of the conveyor belt in the transport direction and both the sides of the packaging box 1 in the width direction.

The opening devices 60-1, 60-2, 60-3 and 60-4 may be paired by two. The rod members 68 of a pair of driving module 60-1 and 60-2 may be positioned opposite to each other in the width direction to open the first pair of upper panels 2 and 3 placed on the second pair of upper panels of the packaging box 1, and the rod members 68 of the other pair of opening devices 60-3 and 60-4 may be positioned opposite to each other in the transport direction to open the second pair of upper panels 4 and 5 of the packaging box 1.

The description describes the operation of opening the packaging box 1 according to the configuration of the suctioning and lifting device 50 and the opening device 60 as described above with reference to FIGS. 9 to 11 schematically showing the devices and packaging box 1.

Figure 9:
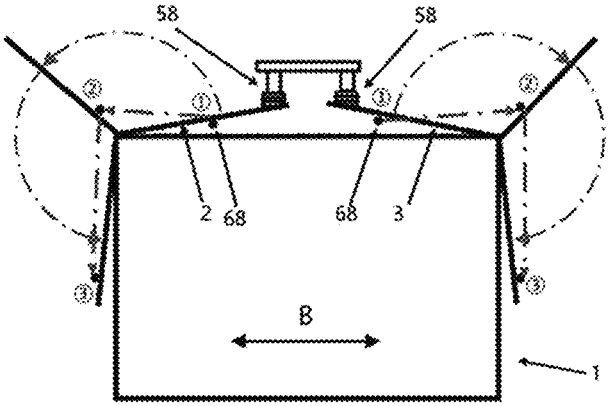
FIGS. 9 to 12 are views each showing an operation of the opening device in the opening system of an embodiment of the present invention.
Figure 10:
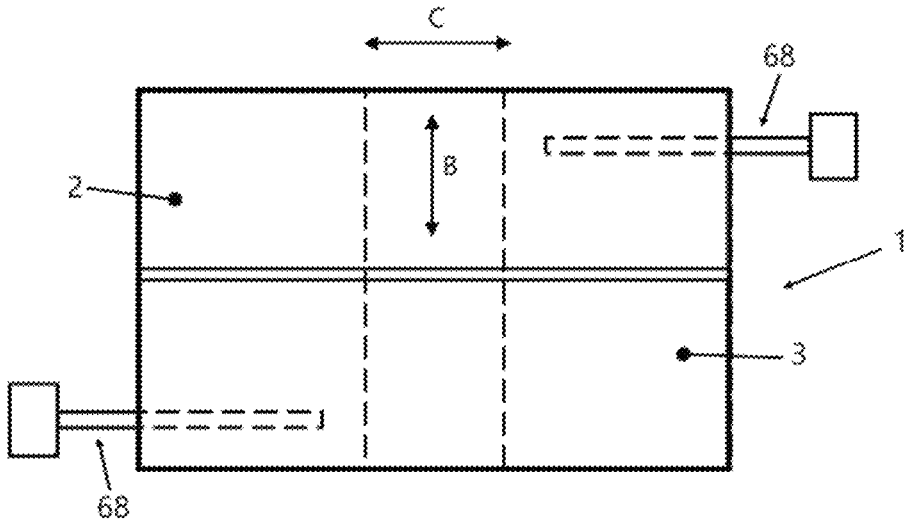

First, the packaging box 1 may be fixed at the position where its opening operation is performed by the fourth to seventh stop plates 71 to 74. As shown in FIGS. 9 and 10, the packaging box 1 may be positioned for the first pair of upper panels 2 and 3 to be positioned opposite to each other in the transport direction (indicated by arrow B). Here, the rod members 68 of the opening device 60 may be all retreated from the position of the packaging box 1.

The suctioning and lifting device 50 may be operated when the packaging box 1 is fixed in place.

Referring to FIG. 9, the two vacuum aspirators 58 attached to the first mounting panel 56 of the suctioning and lifting devices 50, may respectively be positioned on the first pair of upper panels 2 and 3 of the packaging box 1 to be raised to a certain height while vacuum-suctioning the upper panels. The upper panels 2 and 3 may thus be spaced apart from upper edges of the side surfaces of the packaging box 1 to have a space therebetween.

Accordingly, the tips of the rod members 68 may be positioned to face the space between the upper edges and tips of the side surfaces of the packaging box 1 by the operations of the second driving unit 64 and the third driving unit 66 of the two driving modules 60-1 and 60-2 among the opening device, each positioned to open the first pair of upper panels 2 and 3. Next, the first driving units 62 of the driving modules 60-1 and 60-2 may be driven to insert the respective rod members 68 into the space under the upper panels 2 and 3 as shown in FIG. 10.

The vacuum suction of the vacuum aspirator 58 of the suctioning and lifting device 50 may be stopped when the respective rod members 68 are inserted under the upper panels 2 and 3, and the suctioning and lifting device 50 may be retreated outward from its position placed on the packaging box 1.

Next, the third driving unit 66 may be driven to move the respective rod members 68 obliquely from position ① in FIG. 9 to the outside of the packaging box 1 to be placed on position ②, which is above the outside of the packaging box 1. The upper panels 2 and 3 may be pivoted about their boundaries with the side surfaces of the packaging box 1 by the movement of the rod members 68 to be placed on position ② inclined outward the packaging box 1.

Next, the second driving unit 64 may be driven to move the respective rod members 68 vertically downward from position ② in FIG. 9 to be placed on position ③ adjacent to a lower portion of the packaging box 1. The upper panels 2 and 3 may be further rotated about their boundaries with the side surfaces of the packaging box 1 by the movement of the rod members 68 to be placed on position ③. The rod members 68 may be placed adjacent to an outer surface of the packaging box 1 at position ③, and the upper panels 2 and 3 may be in contact with the outer surface of the packaging box 1.

In this way, it is possible to open the first pair of upper panels 2 and 3 placed on the second pair of upper panels among the upper panels 2, 3, 4 and 5 of the packaging box 1.

Next, the suctioning and lifting device 50 may be moved onto the packaging box 1 again, and the two vacuum aspirators 58 attached to the second mounting panel 57 of the suctioning and lifting devices 50 may respectively be placed on the second pair of upper panels 4 and 5 of the packaging box 1 to be raised to the certain height while vacuum-suctioning the upper panels. Accordingly, the upper panels 4 and 5 may be spaced apart from the upper ends of the side surfaces of the packaging box 1 to have a space therebetween.

Figure 11:
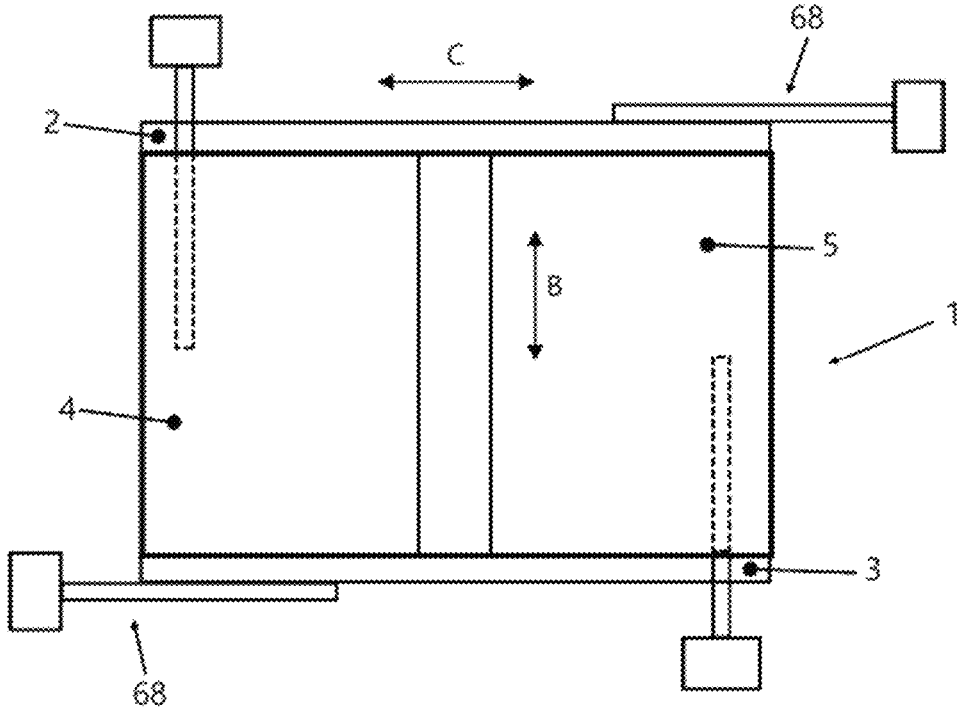

The opening devices 60-3 and 60-4 of the opening device, positioned to open the second pair of upper panels 4 and 5, may be operated to insert the respective rod members 68 into a space under the upper panels 4 and 5 as shown in FIG. 11.

Next, the second pair of upper panels 4 and 5 may be opened while being in close contact with the side surfaces of the packaging box 1 by the same operation as the operation of opening the first pair of upper panels 2 and 3.

Figure 12:
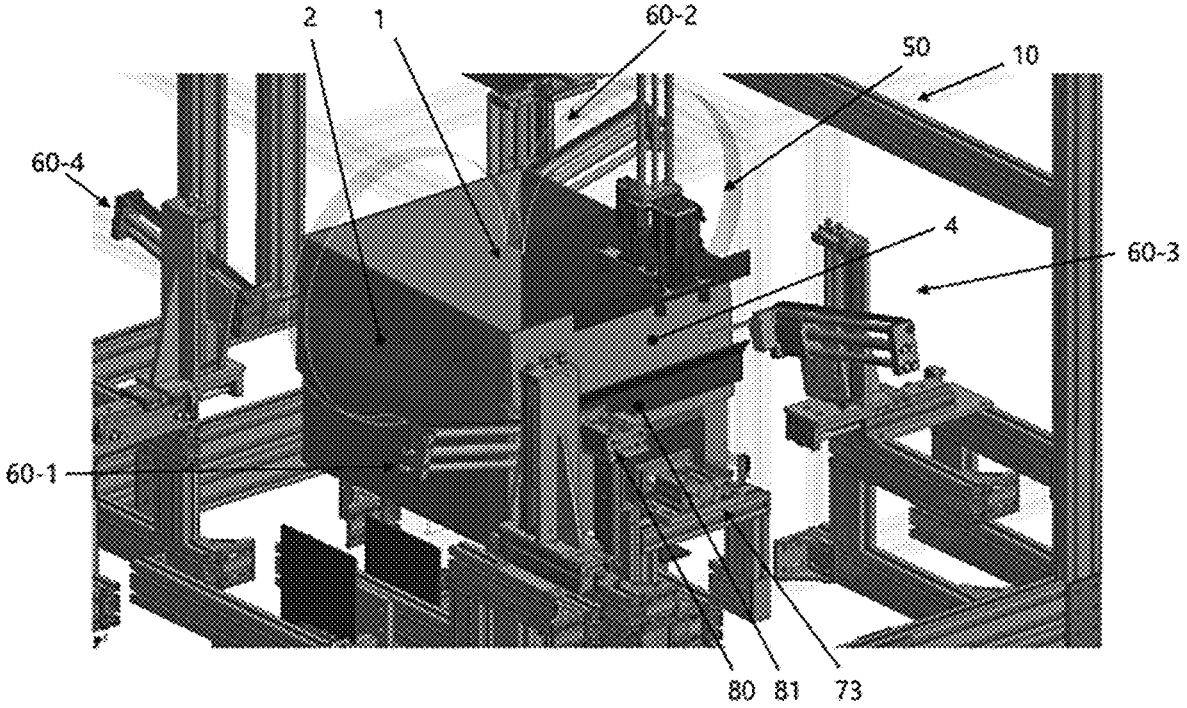

FIG. 12 shows that the upper panels 2, 3, 4 and 5 are all opened by the above operations.

Referring to FIG. 12, a holding plate 81 and a driving module 80 are shown as holding means for maintaining the second pair of upper panels 4 and 5 of the upper panels to be opened.

When all the upper panels 2, 3, 4 and 5 are opened, the packaging box 1 may be transported downstream in the transport direction by the conveyor belts 21 to take out the product accommodated in the packaging box 1. For transporting the packaging box, the rod members 68 of all the opening devices, allowing the upper panel 2, 3, 4 and 5 to be in close contact with the side surfaces of the packaging box, may be retreated outward the packaging box 1.

Accordingly, the upper panels 2, 3, 4 and 5 may be rotated in reverse due to elasticity of their material. However, the second pair of upper panels 4 and 5 opened in the width direction may be maintained in close contact with the side surfaces of the packaging box 1 by the holding plate 81.

The holding plate 81 may be elongated in the transport direction, and the driving module 80 may be moved forward while the second pair of upper panels 4 and 5 are opened by the rod members 68 of the opening device to allow the second pair of upper panels to be maintained in the close contact with the side surfaces of the packaging box 1.

The conveyor belt 21 may be moved to transport the packaging box 1 downstream, and during the transport process, the second pair of upper panels 4 and 5 in close contact with the outer surfaces of the packaging box 1 may be maintained in such close contact while sliding against the holding plate 81.

Accordingly, the packaging box 1 may be transported downstream without an event in which the second pair of upper panels 4 and 5 is reversely rotated by the elasticity to interfere with the adjacent frame device 10 or the retreated opening device 80.

Although the configuration and operation of the opening system of a packaging box according to the embodiment of the present invention have been described above, the present invention is not limited to the disclosed embodiment and various modifications and additions of elements are possible within the scope of the present invention as disclosed in the claims.

The invention claimed is:

1. An opening system of a packaging box, in which the opening system opens the packaging box including upper panels respectively extended from side panels opposite to each other to serve as an upper surface, and bonded to each other by using an adhesive tape as their end portions are in contact with each other, thereby closing the upper surface, the system comprising:

a cutting device for cutting the adhesive tape while being moved along the end portions of the upper panels, opposite to each other;

a suctioning and lifting device for suctioning the upper panels separated from each other because the adhesive tape thereon is cut by the cutting device, and pulling the upper panels upward from the packaging box for the upper panels to be spaced apart from the side panels;

rod members elongated to be inserted into gaps when the gaps are formed between the upper panels and upper edges of side surfaces of the packaging box because the upper panels are spaced apart from the side panels by the suctioning and lifting device; and an opening device for moving the respective rod members maintained in contact with lower surfaces of the upper panels for the upper panels to be pivoted outward from their boundaries with the side panels, wherein the packaging box includes four side panels and four upper panels each extended from the four side panels, the upper panels include a first pair of two of the upper panels opposite to each other and a second pair of two of the upper panels opposite to each other and placed perpendicular to the first pair of the upper panels, the first pair of the upper panels are placed on the second pair of the upper panels and bonded to each other by the adhesive tape as their end portions are in contact with each other, the second pair of the upper panels include end portions opposite to each other, the rod members are provided for the respective upper panels, the cutting device is provided to cut the adhesive tape bonding the first pair of the upper panels to each other, and the suctioning and lifting device is provided to suction each of the first pair of the upper panels and the second pair of the upper panels.

2. The system of claim 1, wherein the opening device performs a first movement for linearly moving the respective rod members outward the packaging box and a second movement for linearly moving the respective rod members downward the packaging box, and the upper panel is opened by being pivoted from the upper surface of the packaging box in the first movement, and the upper panel is placed to be in contact with an outer surface of the side panel in the second movement.

3. The system of claim 1, wherein the opening device includes a first driving unit driven to be adjacent to or spaced apart from the packaging box, a second driving unit coupled to and driven vertically with respect to the first driving unit, a fixed block coupled to and moved with respect to the second driving unit in a horizontal direction or at a predetermined inclination angle in the horizontal direction, and one of the rod members fixed to the fixed block and extended parallel to a direction in which the first driving unit is driven.

4. The system of claim 1, further comprising holding means for maintaining the upper panels pivoted parallel to the side panels of the packaging box by the rod members to respectively be in close contact with the side panels.

5. The system of claim 1, wherein the suctioning and lifting device includes vacuum aspirators spaced apart from each other and respectively vacuum-suctioning the two upper panels opposite to each other.

6. An opening system of a packaging box, in which the opening system opens the packaging box including upper panels respectively extended from side panels opposite to each other to serve as an upper surface, and bonded to each other by using an adhesive tape as their end portions are in contact with each other, thereby closing the upper surface, the system comprising:

a cutting device for cutting the adhesive tape while being moved along the end portions of the upper panels, opposite to each other;

a suctioning and lifting device for suctioning the upper panels separated from each other because the adhesive tape thereon is cut by the cutting device, and pulling the upper panels upward from the packaging box for the upper panels to be spaced apart from the side panels;

rod members elongated to be inserted into gaps when the gaps are formed between the upper panels and upper edges of side surfaces of the packaging box because the upper panels are spaced apart from the side panels by the suctioning and lifting device; and an opening device for moving the respective rod members maintained in contact with lower surfaces of the upper panels for the upper panels to be pivoted outward from their boundaries with the side panels, wherein the opening device performs a first movement for linearly moving the respective rod members outward the packaging box and a second movement for linearly moving the respective rod members downward the packaging box, and the upper panel is opened by being pivoted from the upper surface of the packaging box in the first movement, and the upper panel is placed to be in contact with an outer surface of the side panel in the second movement.

7. An opening system of a packaging box, in which the opening system opens the packaging box including upper panels respectively extended from side panels opposite to each other to serve as an upper surface, and bonded to each other by using an adhesive tape as their end portions are in contact with each other, thereby closing the upper surface, the system comprising:

a cutting device for cutting the adhesive tape while being moved along the end portions of the upper panels, opposite to each other;

a suctioning and lifting device for suctioning the upper panels separated from each other because the adhesive tape thereon is cut by the cutting device, and pulling the upper panels upward from the packaging box for the upper panels to be spaced apart from the side panels;

rod members elongated to be inserted into gaps when the gaps are formed between the upper panels and upper edges of side surfaces of the packaging box because the upper panels are spaced apart from the side panels by the suctioning and lifting device; and an opening device for moving the respective rod members maintained in contact with lower surfaces of the upper panels for the upper panels to be pivoted outward from their boundaries with the side panels, wherein the opening device includes a first driving unit driven to be adjacent to or spaced apart from the packaging box, a second driving unit coupled to and driven vertically with respect to the first driving unit, a fixed block coupled to and moved with respect to the second driving unit in a horizontal direction or at a predetermined inclination angle in the horizontal direction, and one of the rod members fixed to the fixed block and extended parallel to a direction in which the first driving unit is driven.

* * * * *